United States Patent [19]

Wakabayashi

[11] 4,287,829

[45] Sep. 8, 1981

[54] CARRIER STOPPING DEVICE FOR POWER-AND-FREE CONVEYOR

[75] Inventor: Takao Wakabayashi, Toyonaka, Japan

[73] Assignee: Nakanishi Metal Works Co., Ltd., Tenmabashi, Japan

[21] Appl. No.: 945,795

[22] Filed: Sep. 26, 1978

[30] Foreign Application Priority Data

| | | | |
|---|---|---|---|
| Oct. 5, 1977 | [JP] | Japan | 52-134583 |
| Oct. 5, 1977 | [JP] | Japan | 52-134584 |
| Apr. 6, 1978 | [JP] | Japan | 53-45746 |

[51] Int. Cl.[3] ..... B61B 10/02

[52] U.S. Cl. ..... 104/172 S; 104/89

[58] Field of Search ..... 104/172 S, 250, 89

[56] References Cited

U.S. PATENT DOCUMENTS

| | | | |
|---|---|---|---|
| 3,712,241 | 1/1973 | Kuwertz | 104/172 S |
| 3,906,864 | 9/1975 | Kuwertz | 104/172 S |
| 3,913,494 | 10/1975 | Coleson et al. | 104/172 S |
| 4,038,925 | 8/1977 | Kuwertz | 104/172 S |

FOREIGN PATENT DOCUMENTS

| | | | |
|---|---|---|---|
| 2132502 | 1/1973 | Fed. Rep. of Germany | 104/172 S |
| 335912 | 1/1973 | U.S.S.R. | 104/250 |

*Primary Examiner*—John J. Love
*Assistant Examiner*—Ross Weaver
*Attorney, Agent, or Firm*—Armstrong, Nikaido, Marmelstein & Kubovcik

[57] ABSTRACT

A power-and-free conveyor includes a number of pusher dog supporting members attached to a drive chain on a power line. Each pusher dog supporting member includes a pusher dog pivoted at an upper portion thereof and a stopper stopping the pusher dog in a vertical downwardly directed position, where the pusher dog can engage with the free trolley included in a carrier on a free line. The stopper has a pusher dog disengaging portion extending outward therefrom. A disengaging device is disposed on a conveyor line at a location where the carrier is to be brought to a stop. The disengaging device has a stopper raising member which projects into the path of travel of the pusher dog disengaging portion of the stopper. When the carrier reaches the location, the pusher dog disengaging portion of the stopper comes into contact with the stopper raising member which has already projected into the path and the stopper is raised, whereupon the pusher dog is released from the stopper and is disengaged from the trolley. As a result of that the carrier is brought to a stop.

6 Claims, 10 Drawing Figures

CARRIER STOPPING DEVICE FOR POWER-AND-FREE CONVEYOR

BACKGROUND OF THE INVENTION

1. Field of the Invention

This invention relates to a power-and-free conveyor, and more particularly to a device for stopping carriers and accumulating following carriers in a power-and-free conveyor of the type in which pushers attached to a drive chain on a power line engage with one of rear surface of covers mounted on trolleys of which a carrier on a free line is composed.

Throughout the specification and the appended claims, the terms "front" or "forward" and "rear" or "rearward" are based on the direction of travel of the conveyors. Thus, the former refers to the direction in which the conveyor advances and the latter to the opposite direction.

2. Description of the Prior Art (Prior Art Statement)

As disclosed in U.S. Pat. No. 3,906,864 and U.S. Pat. No. 4,038,925, a power-and-free conveyor of the type above mentioned is already known. The power-and-free conveyor includes a number of pusher dogs pivoted at their upper portion by pins on pusher dog supporting members attached to a drive chain on a power rail and engageable with a rear surface of a cover mounted on a front free trolley included in a carrier. The pusher dog supporting member is further provided with a stopper and other auxiliary members for holding the pusher dog in engagement with the front trolley to advance the carrier and cooperate with a cam member of a stop means disposed on the conveyor line to bring the carrier to a stop. The stopper stops the pusher dog in its vertical downwardly directed position where the pusher dog can engage with the trolley. When the carrier reaches the location where the carrier is to be stopped, a downwardly projecting member of the auxiliary members comes into contact with the cam which has already projected into the path of travel of the member. As a result of that the pusher dog is released from the stopper and is disengaged from the trolley. In this case, the pusher dog is released from the stopper by the medium of the auxiliary members including the downwardly projecting member, and the cam of the stop means has to project into the path of travel of the trolley.

SUMMARY OF THE INVENTION

The object of this invention is to provide a carrier stopping device for a power-and-free conveyor, which includes a disengaging device cooperating with stoppers and directly releases pusher dogs from the engagement with the stoppers, without any projection of disengaging or stopping means into the path of trolleys included in a carrier.

The further object of this invention is to provide a disengaging device for use with a power-and-free conveyor.

The present invention provides an improvement in a power-and-free conveyor including a power rail having a drive chain, a free rail provided below the power rail at a predetermined distance therefrom, a plurality of carriers movably supported by the free rail, each carrier having an engageable portion, a plurality of pusher dogs engageable with the engageable portion of the carriers, a pusher dog supporting member attached to the drive chain, and a disengaging means located at a position where the carrier is to be brought to a stop, the pusher dogs each being pivotally supported at an upper portion thereof on the pusher dog supporting member. The improvement is wherein, the pusher dog supporting member includes a stopper pivoted at its front end, a stopper receiving means for normally supporting the stopper in a substantially horizontally directed position, a stopper raising lever pivoted at its rear end below the stopper, and a lever receiving piece pivotally supported rearwardly and upwardly, wherein the rear end of the stopper is in engagement with the top of the pusher dog, the stopper has a pusher dog disengaging portion extending outward therefrom, the stopper raising lever has a stopper raising portion upwardly extending from its rear portion, and the lever receiving piece has a receiving portion on which the front free end of the stopper raising lever is received, and wherein the disengaging means includes a stopper raising means for projecting into the path of travel of the pusher dog disengaging portion of the stopper. Accordingly, the carrier can be brought to a stop rapidly and exactly at the desired location on a conveyor line. It is also possible to stop several following carriers one after another and to accumulate them behind the preceding carrier.

It is desired that the stopper raising lever has at its rear portion an upwardly extending projection including a rear portion for receiving the stopper and a front portion for raising the stopper. In this construction, it is not necessary to provide any stopper receiving means such as a pin below the stopper on the pusher dog supporting member, so that the wasteful processes for attaching the pin to the pusher dog supporting member can be eliminated.

It is also desired that the carrier has a stop pin extending outward therefrom and the disengaging device is provided with a carrier stopping member which is projectable into and retractable from the path of travel of the stop pin on the carrier. The stop pin and the carrier stopping member are useful to prevent the carrier advancing slightly by virtue of inertia after the release of the carrier from the pusher dog.

The disengaging device preferably comprises a bracket extending downward and forward and secured to the power rail, a disengaging lever pivoted on the bracket at front end thereof and having an upper piece with a stopper raising member mounted thereon and a lower piece for stopping the carrier, and a hydraulic cylinder for turning the disengaging lever through a predetermined angle. The disengaging device as defined above has a simplified structure and provides an easy control system for stopping and accumulating carriers. The disengaging lever is easily made of a piece of pressed metal plate.

This invention will be described below in greater detail with reference to the accompanying drawings.

DETAILED DESCRIPTION OF THE PREFERRED EMBODIMENT

Figure 1:
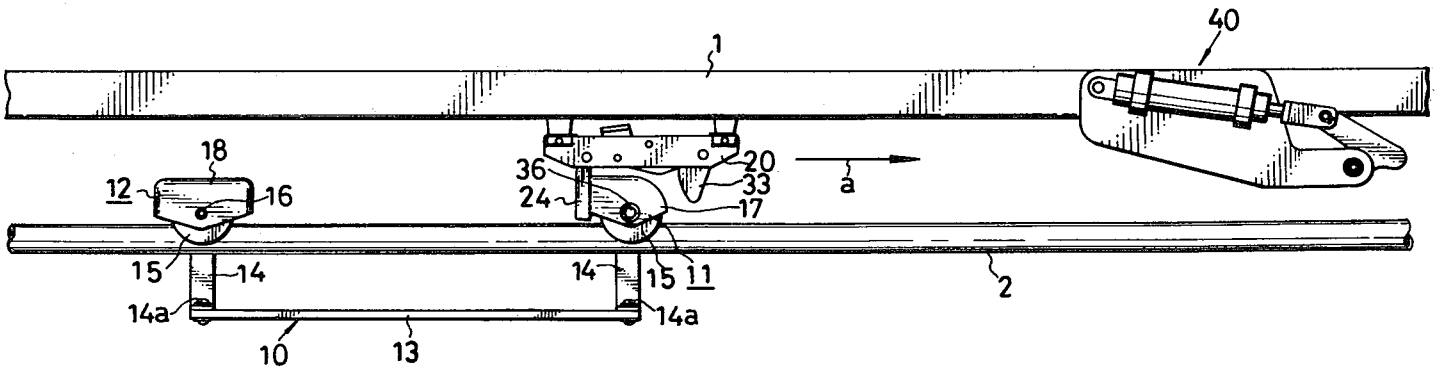
FIG. 1 is a side elevation showing a power-and-free conveyor.
Figure 2:
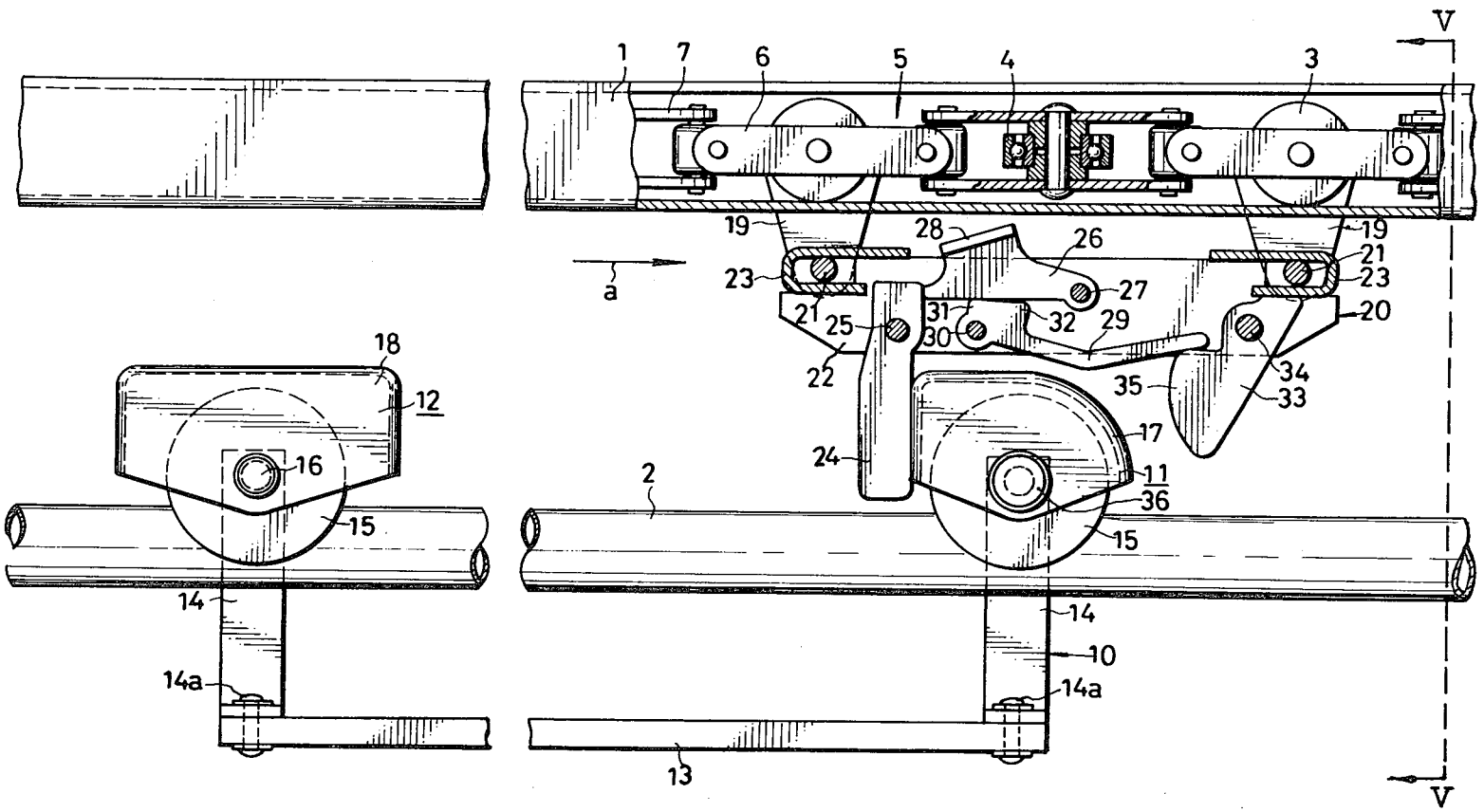
FIG. 2 is an enlarged side elevation showing a power trolleys, a pusher dog supporting member and a carrier.
Figure 5:
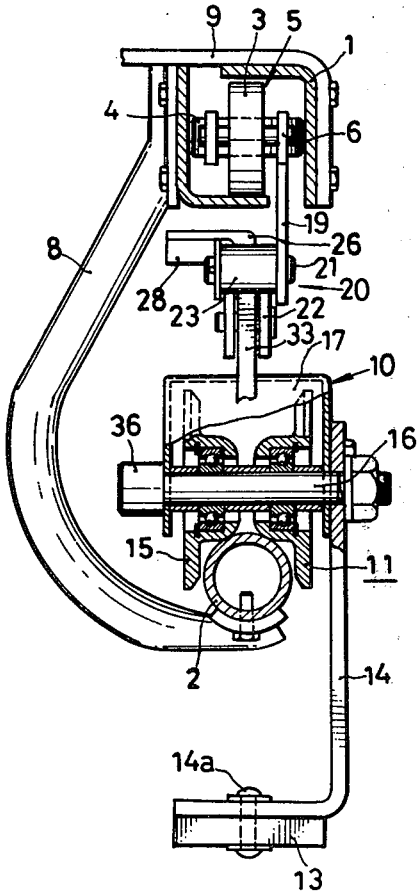
FIG. 5 is a view in section taken along the line V—V in FIG. 2.

Referring to FIGS. 1, 2 and 5, a power-and-free conveyor includes a power rail 1 and a free rail 2 provided below the power rail 1 spaced apart therefrom by a desired distance. The power rail 1 comprises a pair of L-shaped steel members arranged approximately in the form of a square-shaped cross section. The free rail 2 comprises a steel pipe. The rails 1 and 2 are connected to each other by connecting arms 8 arranged at specified intervals and are suspended by supporting members 9. A drive chain 5 in the power rail 1 is formed of pairs of vertical links 6 and pairs of horizontal links 7, the links 6 and 7 being connected together by pins. Pairs of vertical power trolleys 3 rollably supported on the lower horizontal flange of the power rail 1 are pivoted by pins between pairs of vertical links 6 at the middle thereof. Similarly, the horizontal power trolleys 4 for preventing the drive chain 5 from swinging are positioned between a pair of vertical power trolleys 3 and are rollable on the inner surface of the vertical flanges of the power rail 1. The trolleys 4 are pivoted by pins between pairs of horizontal links 7. The power trolleys 3 and 4 are positioned at intervals along the drive chain 5. The drive chain 5 is driven at all times in the direction of an arrow a shown in FIGS. 1 and 2 by a motor and transmission means (not shown). A carrier 10 which travels on the free rail 2 comprises a pair of front and rear free trolleys 11 and 12 rollable on the free rail 2 and a connecting link 13 interconnects free trolleys 11 and 12. The front and rear free trolleys 11 and 12 have front and rear covers 17 and 18 the bottoms of which are opened. The rollers 15 in the covers 17 and 18 are mounted on shafts 16 which are fixedly supported to the covers 17 and 18, respectively. The front cover 17 has a planar rear surface and the front half portion of the cover is rounded. The rear cover 18 has a vertical surface on each of its front and rear ends. The free trolleys 11 and 12 are provided with downwardly directed arms 14 fixed to the covers 17 and 18 at one end of shaft 16. The opposite ends of the link 13 are horizontally pivotally connected to the lower ends of the arms 14 by pins 14*a*. The front free trolley 11 has a stop pin 36 extending outward from the other end of the shaft 16. A disengaging device 40 is provided on a conveyor line of power and free rails 1 and 2 and is located at the desired point where the carrier 10 is to be stopped.

The power trolleys 3 have downwardly projecting supporting arms 19 integral therewith. A pusher dog supporting member 20 is attached to the lower end of supporting arm 19 by pin 21 at one side thereof. The pusher dog supporting member 20 comprises a pair of side plates 22 arranged in parallel with each other and V-shaped connecting pieces 23 which interconnect the side plates 22 at their front and rear ends. A pusher dog 24, a stopper 26, a stopper raising lever 29 and a lever receiving piece 33 are pivotally supported by pins 25, 27, 30 and 34 between the side plates 22 of the pusher dog supporting member 20. Under ordinary conditions as shown in FIG. 2, the pusher dog 24, which is pivoted at its upper portion, is in its vertical downwardly pointing position by gravity. The stopper 26 pivoted at its front end, is supported in its horizontally directed position by the stopper raising lever 29 to be described later and the free end of the stopper 26 is in contact with the top of the pusher dog 24. The stopper 26 is provided with pusher dog disengaging portion 28 integral therewith, extending outward from the upper side thereof and slanting rearward and downward. The stopper raising lever 29 located below the stopper 26 and pivoted at its rear end, has at its rear portion an upwardly extending projection including a rear portion 31 for receiving the stopper 26 and a front portion 32 for raising the stopper 26. The lever receiving piece 33 pivoted at its upper portion, has a receiving portion 35 projecting rearward from its lower portion. The stopper 26 is received on the portion 31 of the lever 29 and the free end of the lever 29 is received on the upper surface of the portion 35 of the piece 33. The top of the lever receiving piece 33 is in contact with the lower surface of the front connecting piece 23, so that the lever receiving piece 33 is supported such that the piece 33 is obliquely directed rearwardly and downwardly as shown in FIG. 2.

Figure 3:
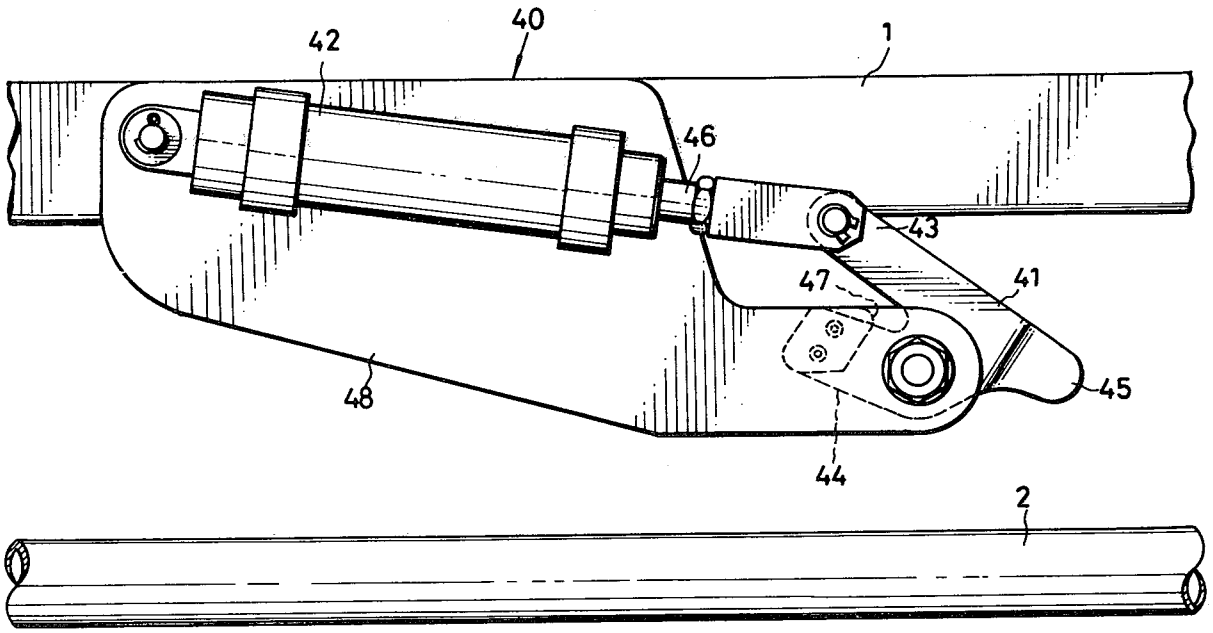
FIG. 3 is an enlarged side elevation showing a stopper disengaging device.
Figure 4:
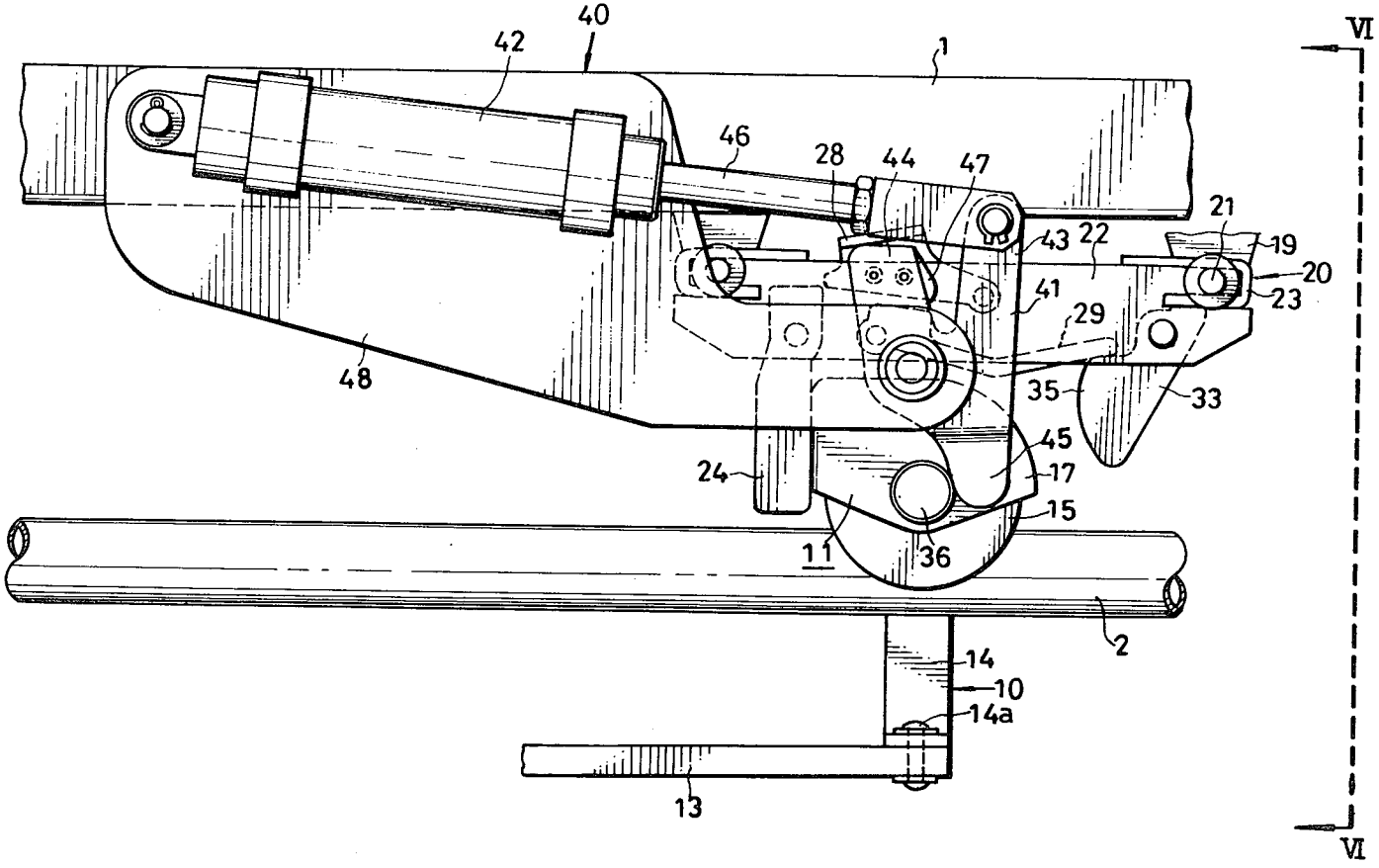
FIG. 4 is an enlarged side elevation showing the stopper disengaging device, the pusher dog supporting member, and a front trolley of the carrier when the carrier stops.
Figure 6:
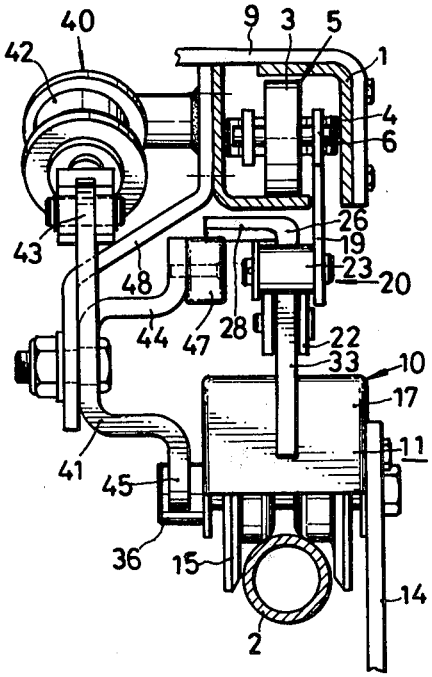
FIG. 6 is a view in section taken along the line VI—VI in FIG. 4.
Figure 7:
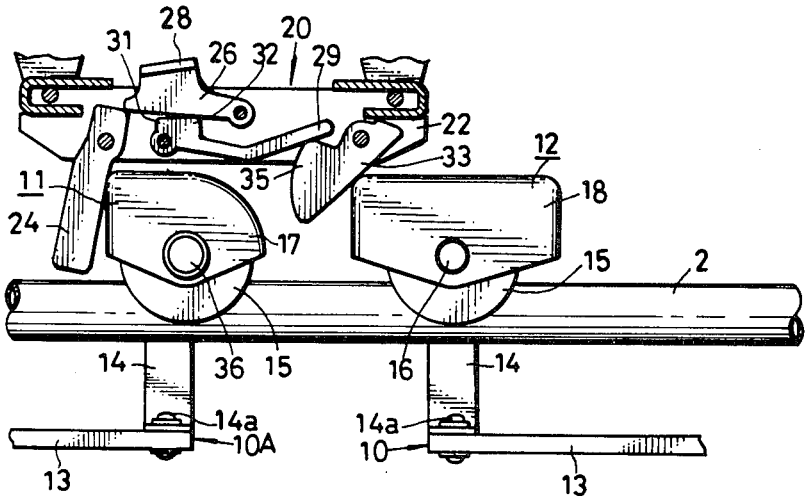
FIG. 7 is an enlarged side elevation showing carriers halted in succession.
Figure 8:
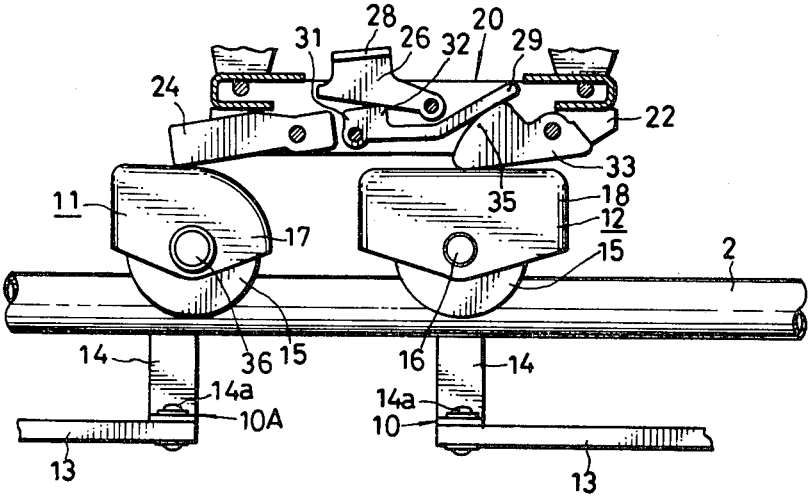
FIG. 8 is an enlarged side elevation showing carriers halted in succession.
Figure 9:
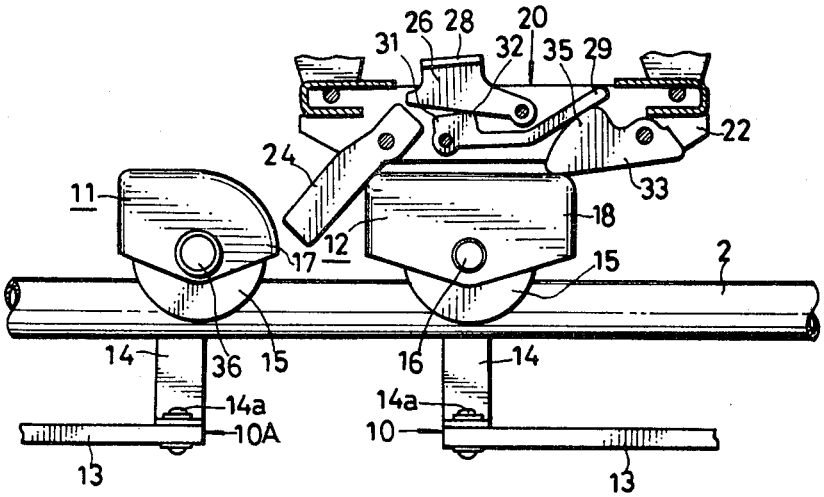
FIG. 9 is an enlarged side elevation showing carriers halted in succession.
Figure 10:
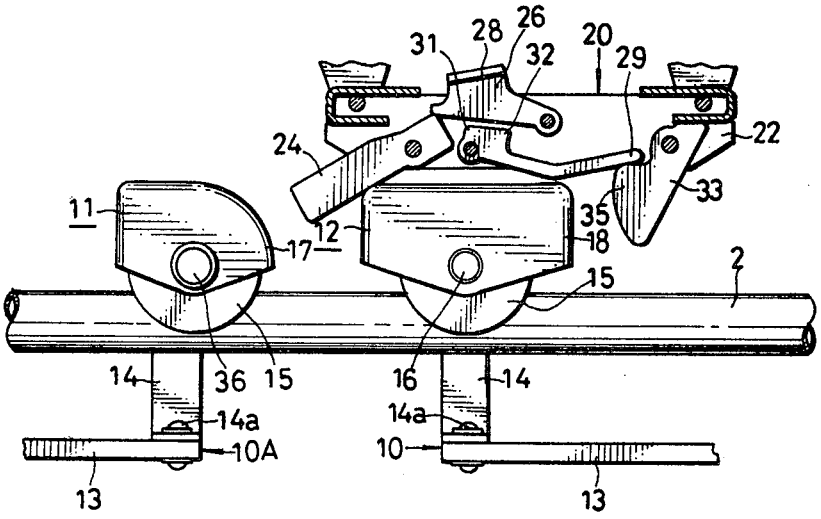
FIG. 10 is an enlarged side elevation showing carriers halted in succession.

With reference to FIGS. 3, 4 and 6, the disengaging device 40 comprises a bracket 48 extending downward and forward and secured to the vertical flange of the power rail 1 on its outer surface. A disengaging lever 41 is pivoted by a pin to the front end of the bracket 48, and hydraulic cylinder 42 is pivotally supported by a pin on the power rail 1 at its end. As shown in FIG. 3, the disengaging lever 41 is approximately Y-shaped and has a pair of front and rear upper pieces 43 and 44 and a carrier stopping member lower piece 45. The front upper piece 43 is connected to the piston rod 46 of the cylinder 42. The rear upper piece 44 and lower piece 45 are bent in a C shape and extend toward the rails 1 and 2. A stopper raising member 47 is mounted on the rear upper piece 44. The lower piece 45 is for stopping the carrier 10. Preferably, the disengaging lever 41 is made of a piece of metal plate by pressing, with the pieces 43, 44 and 45 being integral. The stopper raising member 47 projects into the path of travel of the pusher dog disengaging portion 28 extending outwardly from the stopper 26 pivotally supported on the pusher dog supporting member 20 and is retractable therefrom, and the lower piece 45 of the disengaging lever 41 also projects into the path of travel of the stop pin 36 extending from the front free trolley 11 and is retractable therefrom by turning the disengaging lever 41 through a predetermined angle driven by the cylinder 42.

As mentioned above, the pusher dog 24 supported on the pusher dog supporting member 20 is stopped in its vertical downwardly directed position by contact with the free end of the stopper 26 at its top. Thus, the carrier 10 is driven together with the drive chain 5 in the direction of the arrow a by the engagement of the pusher dog 24, from behind, with the rear surface of the cover 17 on its front free trolley 11.

To bring the advancing carrier 10 to a stop at the location where the disengaging device 40 is provided, the piston rod 46 of the cylinder 42 is projected and the disengaging lever 41 is turned clockwise through a specified angle as seen in FIG. 4, with the result that, the stopper raising member 47 rises to its upper position and the lower piece 45 moves to its lower position. When the front free trolley 11 of the advancing carrier 10 reaches the location, the pusher dog disengaging portion 28 extending outward from the stopper 26 comes into contact with the stopper raising member 47 and is raised, and thereupon the pusher dog 24 is disengaged from the free end of the stopper 26 and the carrier 10 is relieved of the propelling force. Simultaneously, the stop pin 36 on the front free trolley 11 of the carrier 10 comes into contact with the lower piece 45 of the disengaging lever 41, whereupon the carrier 10 is brought to a stop. The pusher dog 24 disengaged from the stopper 26 continues to advance along with the drive chain 5 and passes over the cover 17 of the front free trolley 11 of the stopped carrier 10.

The lower piece 45 of the disengaging lever 41 and the stop pin 36 on the front free trolley 11 are useful to prevent the carrier 10, which is relieved of the propelling force, from advancing slightly by virtue of inertia. However, when the conveyor is driven at a low speed, the carrier 10 is stoppable merely by disengaging the pusher dog 24 from the rear surface of the cover 17 of the front free trolley 11. Thus, the lower piece 45 and the stop pin 36 can be dispensed with.

If there are a number of carriers following the above-mentioned carrier 10, the following carriers are brought to a halt behind the carrier 10 halted in the following manner. With reference to FIGS. 7 to 10, when the following carrier 10A traveling forward with the drive chain 5 by the engagement of another pusher dog 24 with the rear surface of the cover 17 on its front free trolley 11 comes near to the preceding carrier 10 which has already stopped, the lever receiving piece 33 provided on the pusher dog supporting member at front position thereof comes into contact at its front side with the rear surface of the cover 18 on the rear free trolley 12 of the stopping carrier 10, and the lever receiving piece 33 turns clockwise. Since the free end of the stopper raising lever 29, which is received on the receiving portion 35 of the lever receiving piece 33, is raised, the stopper 26 is also raised by means of the front portion 32 of the projection of the lever 29, whereupon the pusher dog 24 is disengaged from the free end of the stopper 26. As a result, the propelling force is removed from the following carrier 10A, and the carrier 10A is stopped behind the preceding carrier 10 (See FIG. 7). As the pusher dog 24 and the lever receiving piece 33 on the pusher dog supporting member 20 still continue to advance along with the drive chain 5 and come to be pivotable, the pusher dog 24 rides upon the cover 17 on the front free trolley 11 of the following carrier 10A and the lever receiving piece 33 rides upon the cover 18 on the rear free trolley 12 of the preceding carrier 10 (See FIG. 8).

When the pusher dog 24 on the pusher dog supporting member 20 has passed over the cover 17 on the front free trolley 11 of the following carrier 10A, the pusher dog 24 immediately comes into contact with the cover 18 on the rear free trolley 12 of the preceding carrier 10 at its rear surface and is held in its slanting position. However, the lever receiving piece 33 on the pusher dog supporting member 20 is still on the cover 18 on the rear free trolley 12 of the preceding carrier 10 and the stopper 26 is being maintained at its upper position, so that the pusher dog 24 and the stopper 26 never engage with each other (See FIG. 9). When the lever receiving piece 33 has passed over the cover 18 on the rear free trolley 12 of preceding carrier 10, the lever receiving piece 33 returns by gravity to its original position, where the top of the lever receiving piece 33 is in contact with the lower surface of the front connecting piece 23. The stopper 26 can fall because the stopper raising lever 29 also has returned to its original position. The pusher dog 24 is still held in the slanting position by means of the contact with the cover 18 on the rear free trolley 12 of the preceding carrier 10, and the free end of the stopper 26 is received on the top of the pusher dog 24, so that the stopper 26 however does not return to its original position and also does not engage the pusher dog 24 (See FIG. 10).

When the pusher dog 24 has passed over the cover 18 on the rear free trolley 12 of the preceding carrier 10, it returns by gravity to its vertical downwardly directed original position, and engages at its top the stopper 26. The pusher dog 24 on the pusher dog supporting member 20 continues to advance along with the drive chain 5, and then it comes into contact with the rear surface of the cover 17 on the front free trolley 11 of the preceding carrier 10. However, as mentioned above, the stopper raising member 47 on the disengaging lever 41 of the disengaging device 40 is still in the path of travel of the pusher dog disengaging portion 28 extending outwardly from the upper side of the stopper 26, whereby the pusher dog 24 is disengaged from the stopper 26 by the stopper raising member 47 in the same manner as already described, and the preceding carrier 10 stays stopped without a propelling force. In this way, if the preceding carrier is brought to a stop, one to many following carriers 10A can be stopped one after another and accumulated behind the preceding carrier.

To bring the stopped preceding carrier 10 into movement again, the disengaging lever 41 is returned to its original position (See FIG. 3). Thus, a pusher dog 24 advancing from behind the stopped carrier 10 comes into engagement with the cover 17 on the front free trolley 11 of the preceding carrier 10 at rear surface thereof, with the result that, the preceding carrier 10 starts to advance along the drive chain 5. After advancing of the preceding carrier 10, the following carriers 10A are also brought into motion again in the same manner as above.

In the foregoing embodiment, a distinct boundary cannot be drawn between a front portion 32 for raising the stopper 26 and a rear portion 31 for receiving the stopper 26 of the projection of the stopper raising lever 29, whereas the stopper raising lever may have two distinctly separated portions which are projecting upwardly therefrom by forming a concavity between the portions and correspond to the portions 31 and 32 respectively. Further, it is possible to provide another stopper receiving means, for example a stopper receiving pin, below the stopper 26 on the pusher dog supporting member 20 without the portion 31 of the stopper raising lever 29. The disengaging lever 41 prescribed is made turnable to raise the stopper 26. However, it is also apparently possible to alternately use a disengaging lever vertically movable and having a stopper raising member. Moreover, a stopper raising means may be formed by extending the upper end of the rear upper piece 44 of the disengaging lever 41 toward the power rail 1 instead of mounting the stopper raising member 47 on the upper piece 44.

This invention may be embodied differently without departing from the spirit and basic features of the invention. The scope of the invention is defined by the appended claims. Various alterations and modifications within the definition and scope of the claims are therefore included in the claims.

What is claimed is:

1. In a power-and-free conveyor including a power rail having a drive chain, a free rail provided below the power rail at a predetermined distance therefrom, both rails extending in a longitudinal direction, a plurality of carriers movably supported by the free rail, each carrier having an engageable portion, a plurality of pusher dogs engageable with the engageable portion of the carriers, a pusher dog supporting member attached to the drive chain, and a disengaging means located at a position where the carrier is to be brought to a stop, the pusher dogs each being pivotably supported at an upper portion thereof on the pusher dog supporting member, the improvement wherein, the pusher dog supporting member includes a stopper pivoted at its front end, a stopper receiving means for normally supporting the stopper in a substantially horizontally directed position, a stopper raising lever pivoted at its rear end below the stopper, and a lever receiving piece pivotally supported rearwardly and upwardly, wherein the rear end of the stopper is in engagement with the top of the pusher dog, the stopper has a pusher dog disengaging portion extending outwardly therefrom, the stopper raising lever has a stopper receiving portion and a stopper raising portion, each of these portions upwardly extending from the rear portion of the stopper raising lever, and the lever receiving piece has a receiving portion on which the front free end of the stopper raising lever is received, wherein the stopper receiving portion stands just above the pivot point of the stopper raising lever and the stopper raising portion is positioned in front of the pivot point, and wherein the disengaging means includes a disengaging lever rotatable through a predetermined angle taken in the longitudinal direction of the power rail and the free rail, the disengaging lever having an upper piece with a stopper raising means mounted thereon, the upper piece extending forward of the power rail.

2. A conveyor as defined in claim 1 wherein the carrier has a stop pin extending outwardly therefrom, and wherein the disengaging lever has a lower piece for stopping the carrier.

3. A conveyor as defined in claim 1 wherein the carrier includes a stop pin extending outward therefrom, and wherein the disengaging means includes a bracket extending downward and forward and secured to the power rail, the disengaging lever being pivoted on the bracket at the front end thereof and a hydraulic cylinder for turning the disengaging lever through the predetermined angle and wherein the disengaging lever has a lower piece for stopping the carrier.

4. In a power-and-free conveyor including a power rail, a free rail, a plurality of carriers movably supported by the free rail, and a disengaging means for disengaging the carriers from the power rail located at a position where the carrier is to be brought to a stop, the improvement wherein, the disengaging means comprises a bracket extending downward and forward and secured to the power rail, a disengaging lever pivoted on the bracket at front end thereof, and a hydraulic cylinder having a piston rod for turning the disengaging lever through a predetermined angle, wherein the disengaging lever is generally Y-shaped and has front and rear upper pieces and a lower piece, the front upper piece being connected to the piston rod of the cylinder, the rear upper piece and lower piece extending toward the power and free rails.

5. In a power-and-free conveyor including a power rail having a drive chain, a free rail provided below the power rail at a predetermined distance therefrom, a plurality of carriers movably supported by the free rail, and a pusher dog supporting member attached to the drive chain, the improvement wherein, the pusher dog supporting member includes a pusher dog pivotally supported at an upper portion thereof, a stopper pivoted at its front end, a stopper raising lever pivoted at its rear end below the stopper, and a lever receiving piece pivotally supported rearwardly and upwardly, wherein the rear end of the stopper is in engagement with the top of the pusher dog, the stopper raising lever has a stopper receiving portion and a stopper raising portion, each of these portions upwardly extending from the stopper raising lever, and the lever receiving piece has a receiving portion on which the front free end of the stopper raising lever is received, and wherein the stopper receiving portion stands just above the pivot point of the stopper raising lever and the stopper raising portion is positioned in front of the pivot point.

6. A disengaging means for use in disengaging a carrier in a power-and-free conveyor having a power rail and a free rail, the disengaging means comprising a bracket extending downward and forward and secured to the power rail, a disengaging lever pivoted on the bracket at front end thereof, and a hydraulic cylinder having a piston rod for turning the disengaging lever through a predetermined angle, wherein the disengaging lever is generally Y-shaped and has front and rear upper pieces and a lower piece, the front upper piece being connected to the piston rod of the cylinder, the rear upper piece and lower piece extending toward the power and free rails.

* * * * *